US005901587A

United States Patent [19]

Chen

[11] Patent Number: 5,901,587

[45] Date of Patent: May 11, 1999

[54] PADLOCK WITH SAFETY LOCKING MECHANISM

[76] Inventor: Cheng-jung Chen, P.O. Box 55-175, Taichung, Taiwan

[21] Appl. No.: 09/026,439

[22] Filed: Feb. 19, 1998

[51] Int. Cl.[6] ..... E05B 37/02

[52] U.S. Cl. ..... 70/28; 70/312

[58] Field of Search ..... 70/28, 301, 304, 70/309, 311, 312, 314, 315, 316, 318, 21–27, 29, 30, 317, 321, 322, 324

[56] References Cited

U.S. PATENT DOCUMENTS

| | | | |
|---|---|---|---|
| 339,208 | 4/1886 | Ponten | 70/312 |
| 977,337 | 11/1910 | Soley | 70/312 |
| 1,714,019 | 5/1929 | Gornicec | 70/28 |
| 4,532,784 | 8/1985 | Yeh | 70/312 |
| 4,711,108 | 12/1987 | Garro | 70/316 |
| 5,193,367 | 3/1993 | Ling | 70/28 |
| 5,359,867 | 11/1994 | Ling et al. | 70/28 |
| 5,609,048 | 3/1997 | Ling | 70/28 |
| 5,765,409 | 6/1998 | Yang | 70/28 |
| 5,782,113 | 7/1998 | Chen | 70/28 |

*Primary Examiner*—Steven Meyers
*Assistant Examiner*—Teri Pham

[57] ABSTRACT

A padlock with safety locking mechanism is provided. The padlock includes a casing, a leverage latch plate in cooperation with a combination locking mechanism to rotatably lock or unlock the padlock and a plurality of sleeves slidably disposed on a cylindrical slide enabling the change of combination code by the users themselves.

1 Claim, 8 Drawing Sheets

PADLOCK WITH SAFETY LOCKING MECHANISM

BACKGROUND OF THE INVENTION

The present invention relates to padlocks and more particularly to a combination padlock with safety locking mechanism including a leverage latch plate which provides a safety locking and unlocking of the padlock without injuring the user's hand and facilitates changing of the combination code.

Typical padlock as shown in FIG. 1 includes a rotatable latch plate operated by user's forefinger, when the latch plate is pressed to rotate inward, it disengages with the locking bar so as to unlock the padlock. Since the latch plate becomes tilted that may lead the finger simultaneously sliding upward to block the gap between the latch plate and the locking bar. This may cause an inconvenience for locking the padlock or injuring the finger. FIG. 2 shows an improved padlock which includes a press button on the opposite side of the latch plate, when the user presses the button to operate the latch plate for locking or unlocking the padlock, it may not injure his (her) finger. However, both the above padlocks equiped with transverse numeral dials which make column of code that goes against the habit of reading. FIG. 3 shows another combination padlock, when the dials are on-combination, one may press the upright latch plate outward for unlocking the padlock, when the latch plate is released, it will automatically resile back to its locking position. However, this type of padlock has also the same disadvantage when the user's finger presses the latch plate, it may hinder the object to lock up.

SUMMARY OF THE PRESENT INVENTION

The present invention has a main object to provide a padlock with safety locking mechanism including a leverage latch plate which is readily operable and prevents the user's finger from injuring.

Another object of the present invention is to provide a padlock with safety locking mechanism including a plurality of vertically rotated numeral dials to form transversely aligned combination code which fits to the habit of reading.

Further object of the present invention is to provide a padlock with safety locking mechanism which facilitates the users to change the old code for their desired combination code.

The present invention will become more fully understood by reference to the following detailed description thereof when read in conjunction with the attached drawings.

DETAILED DESCRIPTION OF THE PREFERRED EMBODIMENT

Figure 1:
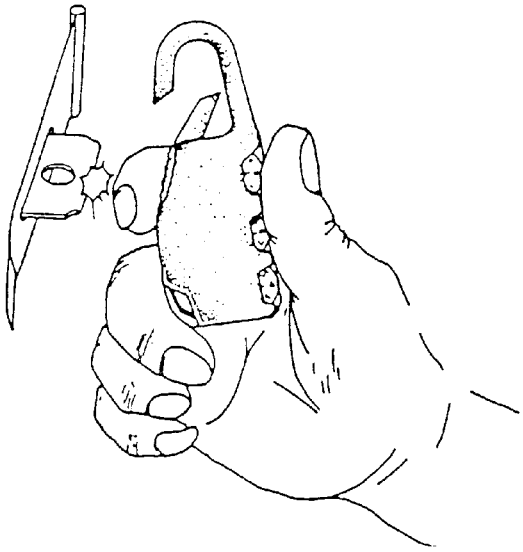
FIG. 1 is a perspective view illustrating an operation of a padlock according to the prior art.
Figure 2:
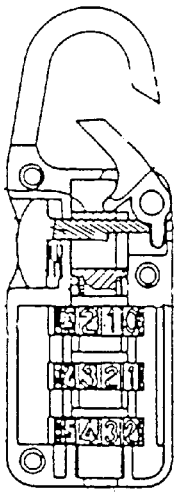
FIG. 2 is an elevational view to show another type of padlock according to the prior art.
Figure 3:
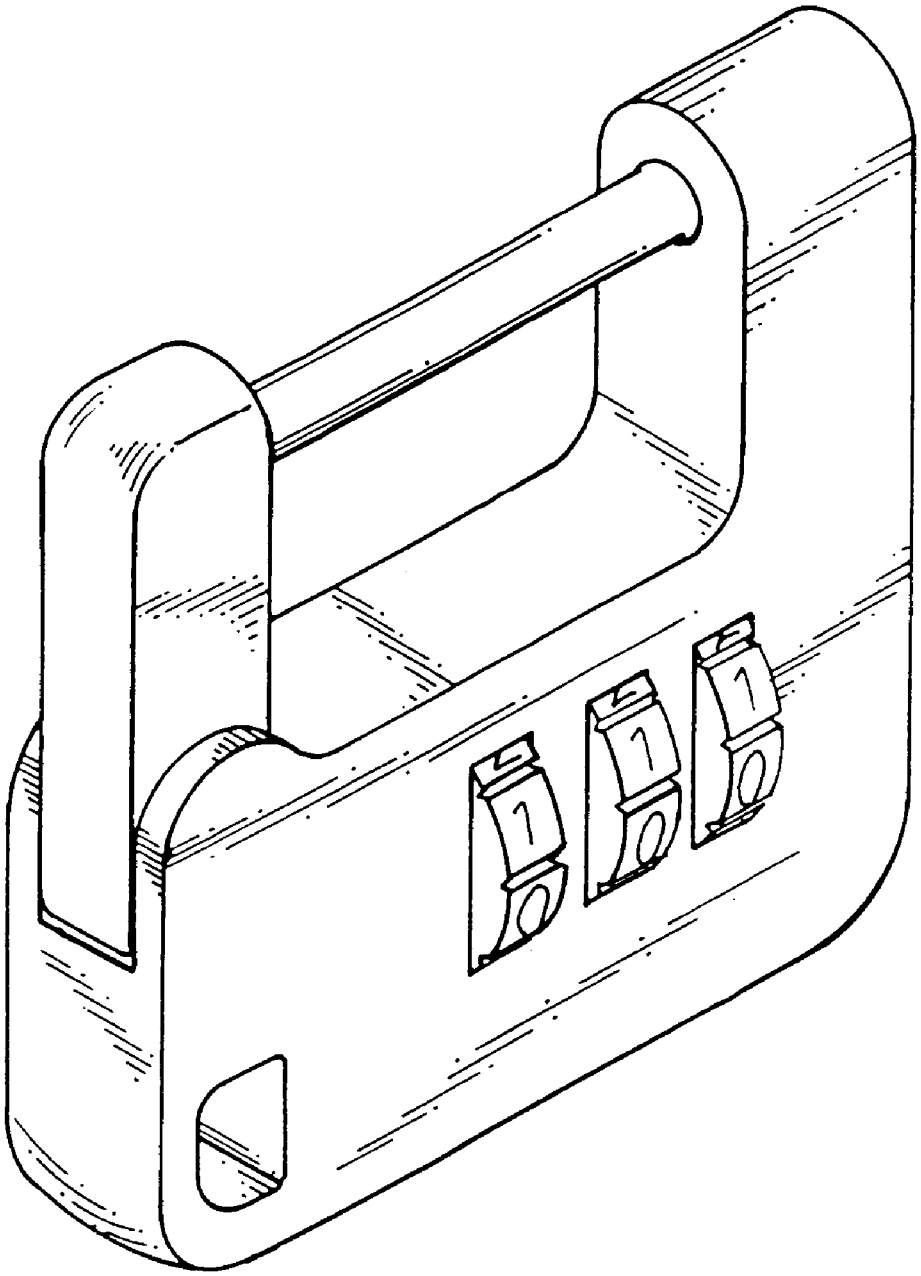
FIG. 3 is a perspective view to show a third type of the padlock according to the prior art.
Figure 4:
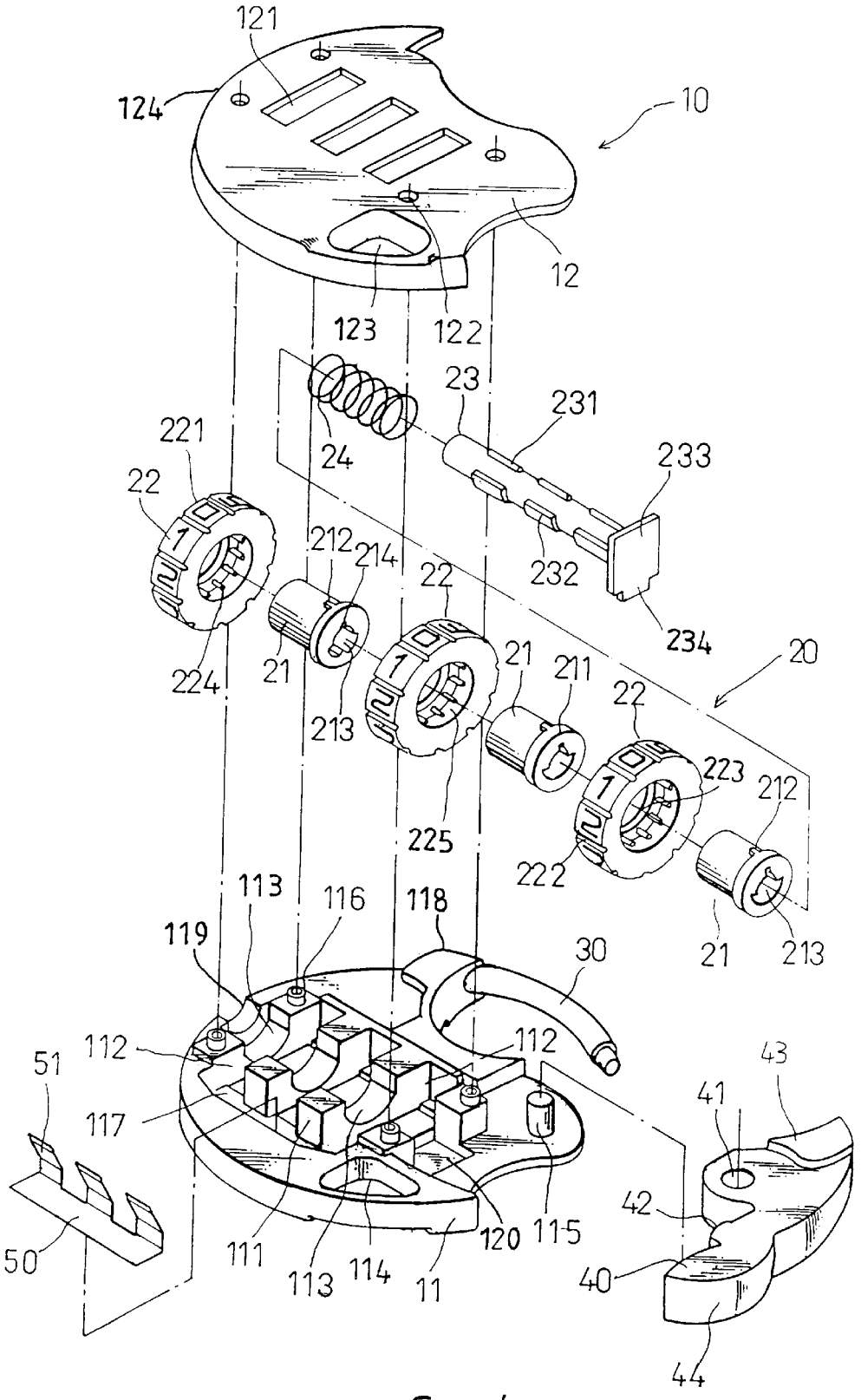
FIG. 4 is a exploded perspective view to show a preferred embodiment according to the present invention.

With reference to FIG. 4, the padlock of the present invention comprises a casing 10, a locking mechanism 20, a locking bar 30, a leverage latch plate 40 and a spring plate 50.

The casing 10 of a roughly circular shape includes a base seat 11 and a lid 12. On the inner surface of the base seat 11, there is a plurality of vertical compartments 111 formed spaced apart at appropriate center portion thereof so as to define a plurality of vertical receiving spaces 112 therebetween each of the compartments 111 has an arcuate groove 113 in center, a first visual window 114 formed in a lower right portion, a pivot 115 projected upward from an upper right portion, a plurality of internally threaded posts 116 spacedly projected upward and a transverse receiving space 117 formed in a lower portion abutting the lower ends of the compartments 111 for receiving the spring plate 50 which has a plurality of elastic extensions 51 spacedly projected upward and engageable into the vertical receiving spaces 112. The base seat 11 further has an extension 118 at an upper left portion to which the locking bar 30 is transversely secured and a first semi-circular hole 119 at a left side. The lid 12 of a shape conformable with the base seat 11 includes a plurality of vertical slots 121 made in registry with the vertical receiving spaces 112 of the base seat 11, a plurality of spaced apertures 122 made in registry with the threaded posts 116, a second visual window 123 made in registry with the first visual window 114 of the base seat 11, and a second semi-circular hole 124 at a left side made in registry with the first semi-circular hole 119 of the base seat 11.

The locking mechanism 20 includes a plurality of sleeves 21 each of which has a hollow cylinder body including a large diameter bottom so as to form a flange 211 extending outward from hereto, a first longitudinal protrusion 212 formed on an outer periphery abutting the flange 211, a semi-circular opening 213 abutting a positioning slot 214 in the bottom, a plurality of annular numeral dials 22 each of which has a plurality of numerals (0–9) 221 formed around outer periphery and partitioned off by a plurality of transverse grooves 222 therebetween, an inward flange 223, a plurality of transverse protrusions 224 spacedly formed around the inner periphery so as to define a plurality of transverse spaces 225 therebetween, a slide 23 including a cylinder body, a plurality of second longitudinal protrusions 231 formed spaced apart along an upper periphery made engageable with the positioning slots 214 of the sleeves 21, a plurality of semi-annular protrusions 232 formed spaced apart along a lower periphery made engageable with the semi-circular openings 213 of the sleeve means 21 and a rectangular block plate 233 including a narrower lower portion 234 formed perpendicular to one end of the body.

The leverage latch plate 40 of a shape generally conforming with the right portion of the base seat 11 includes a vertical axial hole 41 made in registry with the pivot 115, a dome projection 42 projected inward from a lower portion 44 made engageable with the block plate 233, and a locking hole 43 in an upper end made in registry with the locking bar 30.

Figure 9:
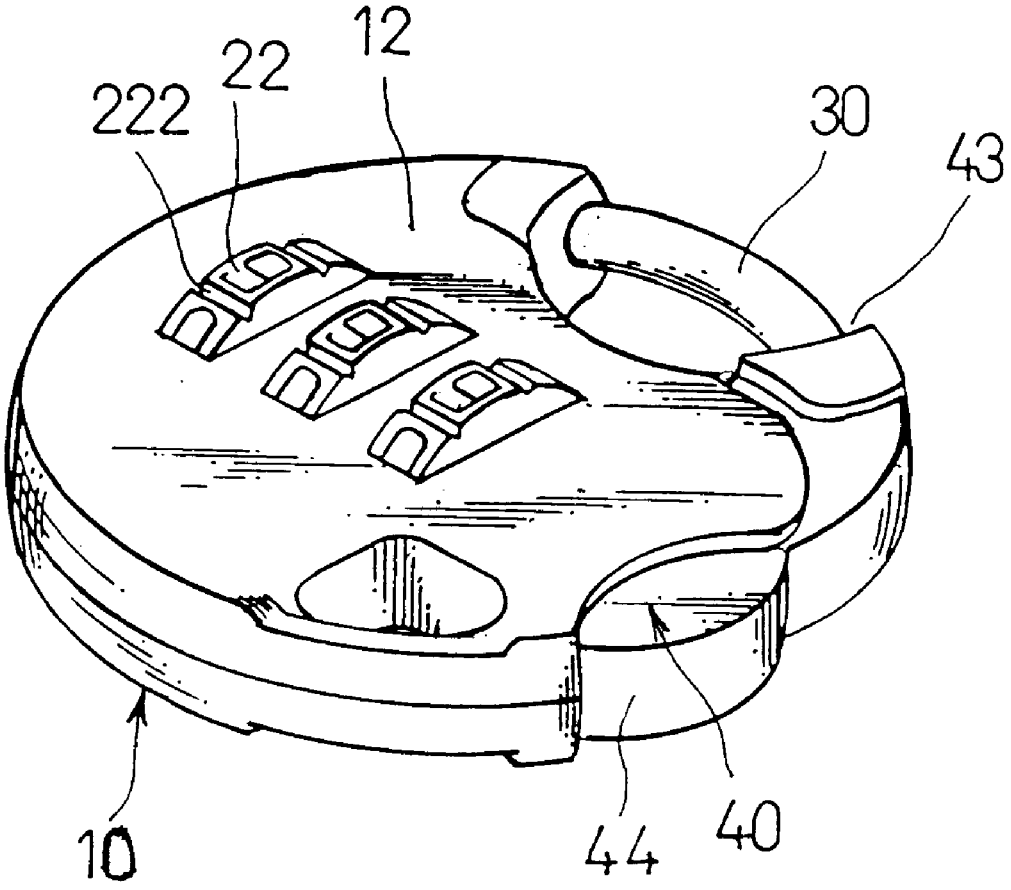
FIG. 9 is a perspective view to show an outlook of the padlock according to the present invention.

When assembling, first combine the locking mechanism 20, by inserting the sleeves 21 into their respective numeral dials 22 with the first longitudinal protrusion 212 engaged into one of the transverse spaces 225 so that the sleeves 21 can be rotated in concert with the numeral dials 22, and wrapping a compression spring 24 onto the slide 23 prior to that the slide 23 sequentially inserting into the sleeves 21 and the second longitudinal protrusions 231 engaged into the positioning slots 214 and the semi-annular protrusions 232 engaged into the semi-circular openings 213, the combined locking mechanism 20 is then disposed into the base seat 11 wherein the numeral dials 22 engage into the respective vertical receiving spaces 112, the sleeves 21 engage into the respective arcuate grooves 113 and the narrower lower portion 234 of the rectangular block plate 233 engages into a narrow space 120 of the base seat 11, and then mounts the leverage latch plate 40 onto the pivot 115 through the vertical axial hole 41 so that it's dome projection 42 stops against the outward surface of the rectangular block plate 233 and its locking hole 43 engages with the locking bar 30, when the spring plate 50 disposes into the transverse receiving space 117, its elastic extensions 51 will engage with the transverse groove 222 of the respective numeral dials 22, finally, mounts the apertures 122 of the lid 12 with their respective posts 116 and secured by screws. FIG. 9 shows an assembled padlock of the present invention wherein the numeral dials 22 are revealed to outside of the padlock through their respective vertical slots 121 and the semi-circular hole 124 engages with the semi-circular hole 119 to form a circular hole in a left side of the padlock. Since the elastic extensions 51 stop against the transverse grooves 222 of the numeral dials 22, it provides a stepped rotation for the dials 22.

Figure 5:
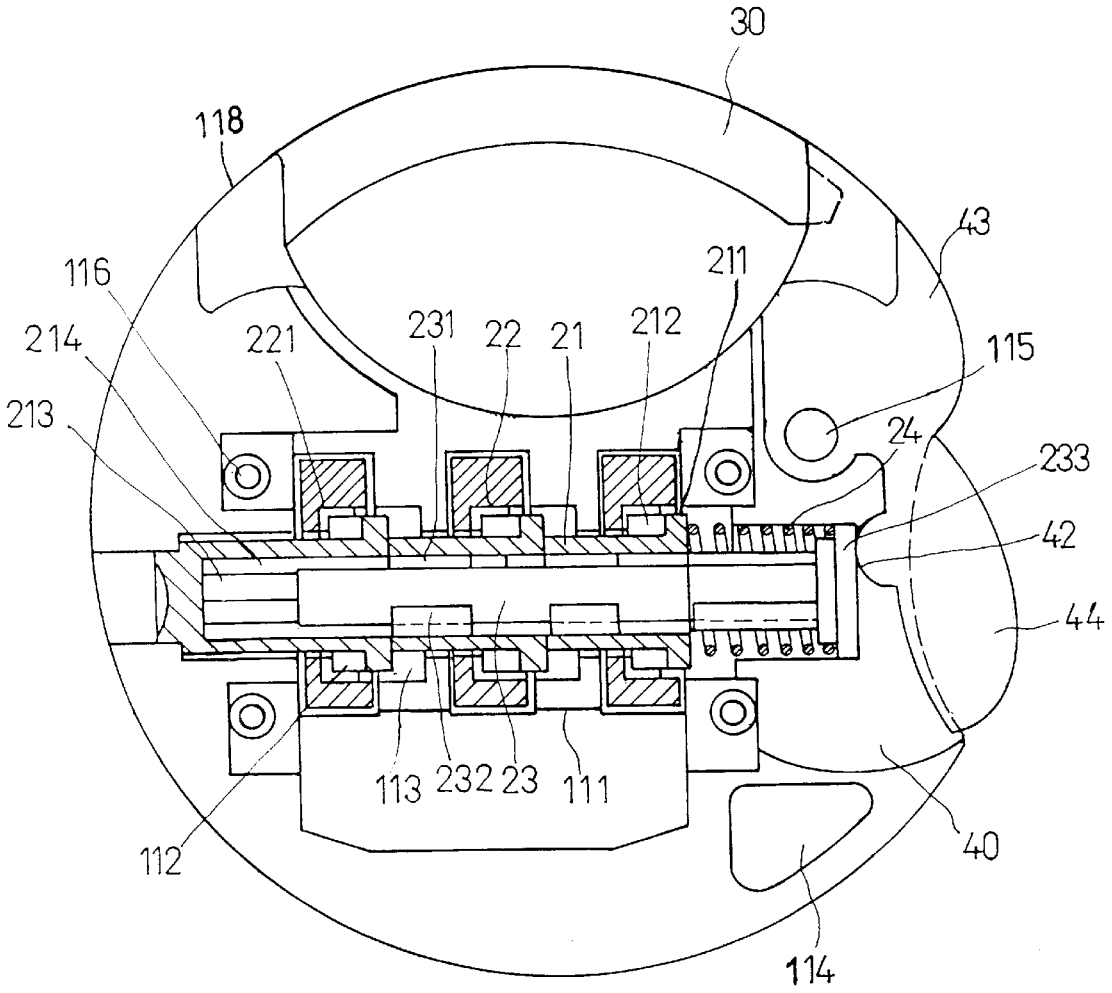
FIG. 5 is an elevational section illustrating that the padlock of FIG. 4 is in locked up position.

FIG. 5 shows that the padlock of the present invention is in locked up state, wherein the numeral dials 22 are not on-combination. Since that the sleeves 21 are rotated in concert with their respective dials 22, the rotation of any dial 22 will cause the disengagement of the positioning slot 214 and the semi-circular opening 213 of the sleeves 21 with the second longitudinal protrusion 231 and the semi-annular protrusion 232 of the slide 23. So that the slide 23 stays at right side of the padlock and can not move leftward and the dome projection 42 of the leverage latch plate 40 is resisted by the block plate 233 preventing the latch plate 40 from rotation. Therefore the padlock is completely locked up.

Figure 6:
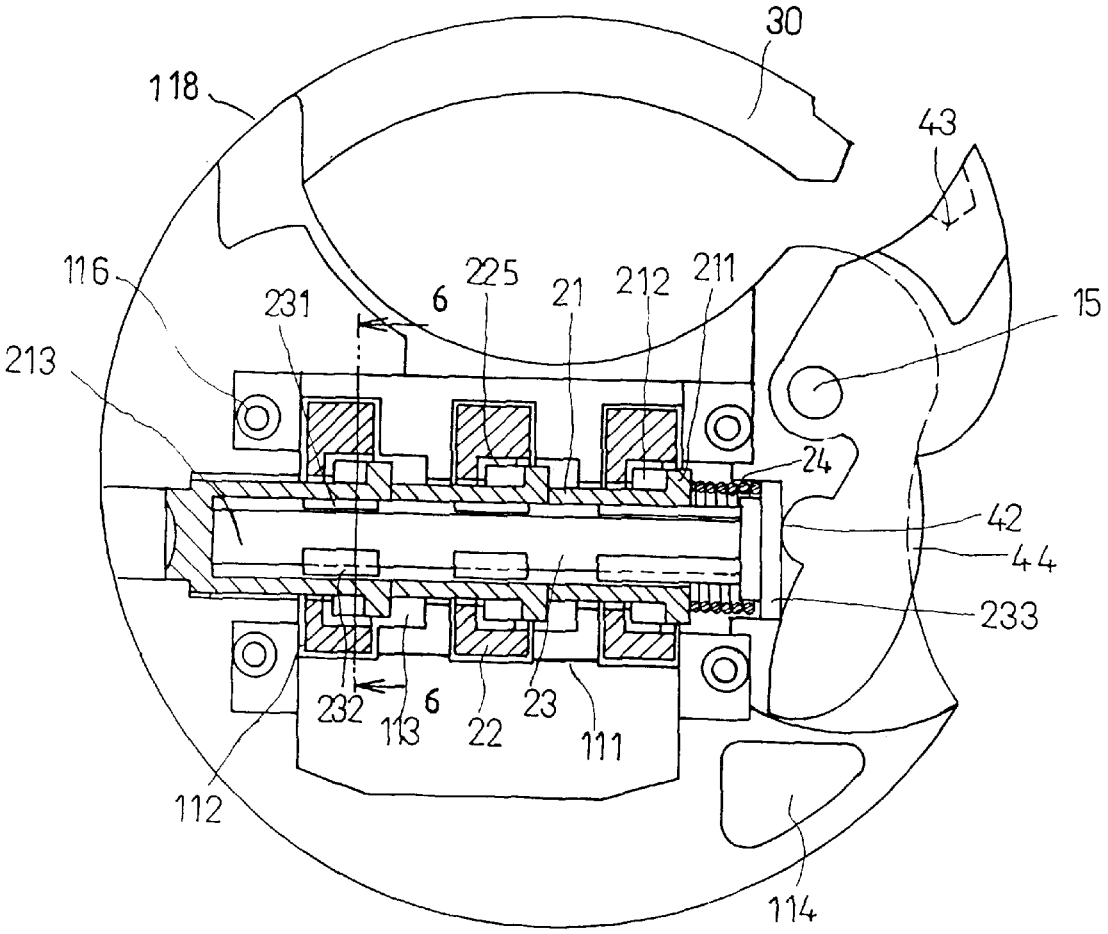
FIG. 6 is an elevational section illustrating that the padlock of FIG. 4 is in unlocked up position.
Figure 7:
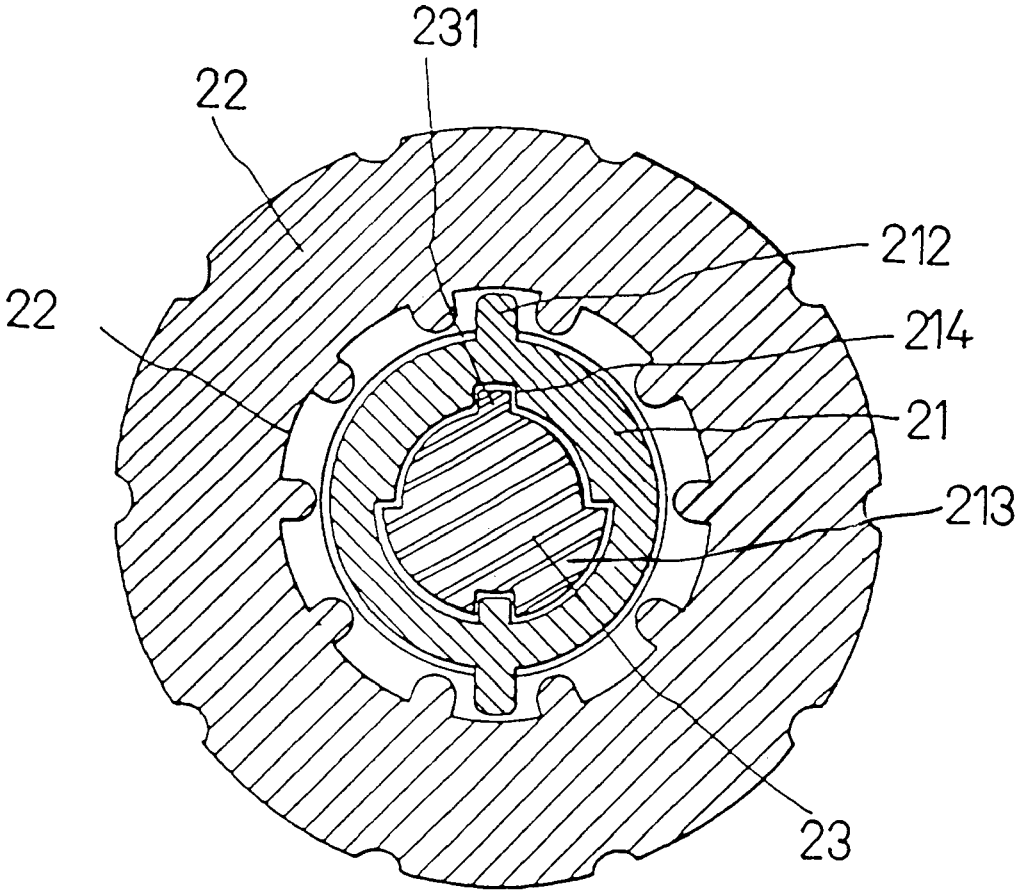
FIG. 7 is a sectional view taken from line 6—6 of FIG. 6.

Referring to FIGS. 6 and 7 of the drawings, when the dials 22 of the padlock are on-combination, all of the second longitudinal protrusions 231 and the semi-annular protrusions 232 of the slide 23 are engageable with the respective positioning slots 214 and the semi-circular openings 213 of all the sleeves 21. So that the slide 23 can move leftward relative to the padlock. When the user presses the lower portion 44 of the leverage latch plate 40, it enables to rotate clockwise to disengage the locking hole 43 with the locking bar 30 so as to unlock the padlock. Since the slide 23 is pushed leftward and the compression spring 24 is compacted to reserve energy, when the latch plate 40 is released by the user, it will rotate immediately counterclockwise to engage with the locking bar 30 again because of the resilient force of the spring 24. Though that the dials 22 keep on combination, one can press the latch plate 40 repeatedly without locking up the padlock. Since the pressing spot is remote from the locking hole 43 of the latch plate 40, it will never injure the user's finger.

Figure 8:
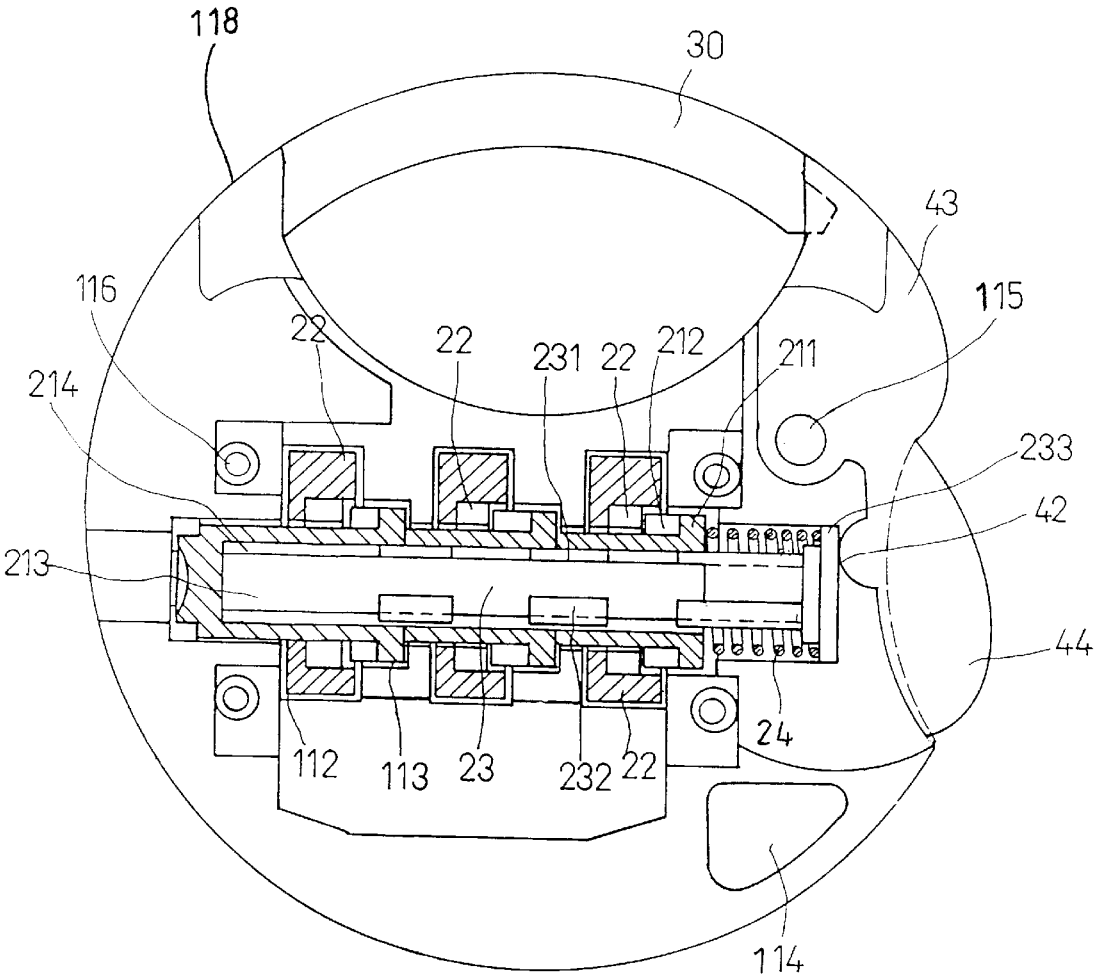
FIG. 8 is an elevational section illustrating that the padlock of FIG. 5 is operable to change the combination code.

Referring to FIG. 8, if the user wants to change the existing code for a desired combination code, he (she) may make the dials 22 on-combination at first, then uses a tip means such as a pen or a toothpick pressing the sleeve means 21 moving rightward relative to the casing 10 via the circular hole at left side of the padlock and to force the first longitudinal protrusion 212 disengaging with the transverse space 225 in the inner periphery of the dials 22. So that the dials 22 can be rotated individually without disturbing the sleeves 21. This time, the user can designate any numeral 221 from each of the dials 22 to form a new combination code for himself (herself). After the new combination code is designated, release the tip means to allow the sleeves 21 all resiled back by the spring 24 to their normal positions, where the first longitudinal protrusions 212 engage with the transverse spaces 225 again, so that the padlock restores to its unlocking position as shown in FIG. 6.

Based on aforediscussed embodiment, the padlock of the present invention provides a simplized structure but multiple functions such as that the leverage latch plate 40 can obviate the user's finger from injuring by the locking bar 30, the permission of changing the combination code by user himself (herself) and especially the vertical rotation of the dials 22 fitting the habit of reading of the combination code.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A padlock with safety locking mechanism comprising:

a casing including a base seat having a plurality of vertical compartments formed spaced apart at a center portion thereof to define a plurality of vertical receiving spaces therebetween, each of the compartments having an arcuate groove in center, a first visual window formed in a lower right portion, a pivot projected upward from an upper right portion, a plurality of posts spacedly projected upward, a transverse receiving space formed in a lower portion abutting the compartments, an extension at an upper left portion to which a transverse locking bar is secured and a first semi-circular hole centrally formed in a left side thereof; a lid mounting on said base seat including a plurality of vertical slots made in registry with the vertical receiving spaces, a plurality of spaced apertures made in registry with the posts for securing said lid to said base seat by means of fastener, a second visual window made in registry with the first visual window and a second semi-circular hole made in registry with the first semi-circular hole of said base seat;

a plurality of annular numeral dials vertically and movably disposed into the vertical receiving spaces of said base seat and revealing out of said lid via the vertical slots and including numerals of 0–9 around outer periphery which are partitioned off by a plurality of transverse grooves therebetween, a plurality of transverse protrusions spacedly formed around inner periphery to define a plurality of transverse spaces therebetween;

a plurality of sleeves engaged into said numeral dials and movably bearing the arcuate grooves of the base seat respectively and each including a hollow interior body, a large diameter bottom to define a circumferential flange therearound, a first longitudinal protrusion formed on an outer periphery abutting said flange, a semi-circular opening abutting a positioning slot in the bottom thereof;

a slide inserting into said sleeves sequentially and including a cylinder body, a plurality of second longitudinal protrusions formed spaced apart along an upper periphery of the body made engageable into said positioning slots of said sleeves, a plurality of semi-annular protrusions formed spaced apart along a lower periphery thereof made engageable within said semi-circular opening of said sleeves and a rectangular block plate including a narrow lower portion formed perpendicular to an outward end of the body;

a spring plate disposed into the transverse receiving space of said base seat and including a plurality of elastic extensions spacedly projected upward and engaged into the transverse grooves of said numeral dials respectively;

a leverage latch means rotatably mounting on the pivot of said base seat and including a vertical axial hole centrally formed in an inward protrusion made in registry with the pivot, a dome projection projected inward from a lower portion made engageable with the rectangular block plate of said slide and a locking hole in an upper end made in registry with said locking bar;

whereby said leverage latch means in cooperation with said numeral dials is rotatably on said pivot for locking or unlocking said slide to facilitate the change of desired combination code for said padlock.

* * * * *